US012012757B2

(12) United States Patent
Kim et al.

(10) Patent No.: US 12,012,757 B2
(45) Date of Patent: Jun. 18, 2024

(54) TIE HOOP UNTYING PREVENTION DEVICE

(71) Applicants: Yong Ju Kim, Seongnam-si (KR); Gyeong Eon Park, Gyeryong-si (KR)

(72) Inventors: Yong Ju Kim, Seongnam-si (KR); Gyeong Eon Park, Gyeryong-si (KR)

( * ) Notice: Subject to any disclaimer, the term of this patent is extended or adjusted under 35 U.S.C. 154(b) by 161 days.

(21) Appl. No.: 17/797,105

(22) PCT Filed: Jan. 7, 2021

(86) PCT No.: PCT/KR2021/000162
§ 371 (c)(1),
(2) Date: Dec. 12, 2022

(87) PCT Pub. No.: WO2021/167244
PCT Pub. Date: Aug. 26, 2021

(65) Prior Publication Data

US 2023/0220670 A1 Jul. 13, 2023

(30) Foreign Application Priority Data

Feb. 17, 2020 (KR) ..... 10-2020-0018744

(51) Int. Cl.
*E04C 5/16* (2006.01)
*E04C 5/06* (2006.01)

(52) U.S. Cl.
CPC ..... *E04C 5/163* (2013.01); *E04C 5/0604* (2013.01)

(58) Field of Classification Search
CPC ..... E04C 5/163; E04C 5/0604; E04C 5/16; E04C 5/161
See application file for complete search history.

(56) References Cited

U.S. PATENT DOCUMENTS

| | | | |
|---|---|---|---|
| 161,409 | A * | 3/1875 | Hardman |
| 3,367,084 | A * | 2/1968 | Reiland |
| 2010/0024344 | A1 | 2/2010 | Murayama et al. |

FOREIGN PATENT DOCUMENTS

| | | | |
|---|---|---|---|
| JP | 2001020459 | A | 1/2001 |
| KR | 101830335 | B1 | 2/2018 |
| KR | 1020180059116 | A | 6/2018 |
| KR | 101927760 | B1 | 12/2018 |
| KR | 102148235 | B1 | 8/2020 |

OTHER PUBLICATIONS

English language Abstract of JP 2001020459 A (Jan. 23, 2001).
(Continued)

*Primary Examiner* — David M Upchurch
(74) *Attorney, Agent, or Firm* — Hershkovitz & Associates, PLLC; Abe Hershkovitz

(57) ABSTRACT

A tie hoop untying prevention device of the present invention may comprise: a body part provided in a shape of surrounding the outer side surface and the upper and lower surfaces of a tie hoop and coupled to the tie hoop; a pair of extension parts provided at opposite ends of the body part, respectively, and formed in directions different from each other; separation preventing parts provided on both side surfaces of the body part, respectively, to prevent separation of the tie hoop; and a tying part provided at each of the corners of the body part to prevent vertical and outward movements of the tie hoop when being coupled to the tie hoop.

9 Claims, 5 Drawing Sheets

(56) References Cited

OTHER PUBLICATIONS

English language Abstract of KR 101927760 B1 (Dec. 11, 2018).
English language Abstract of KR 1020180059116 A (Jun. 4, 2018).
English language Abstract of KR 102148235 B1 (Aug. 26, 2020).
English language translation of the International Search Report in International Application No. PCT/KR2021/000162, mailed on Apr. 5, 2021.

* cited by examiner

TIE HOOP UNTYING PREVENTION DEVICE

TECHNICAL FIELD

The present invention relates to a device for preventing loosening of a band steel (so called as "hoop" or "band reinforcing bar") installed on a main bar.

BACKGROUND ART

Reinforced concrete vertical members such as columns, beams, shear walls, and abutments, which are generally construction structures, are installed a band reinforcing bar in the transverse direction around the main bars, thereby fixing their main bars, and preventing the buckling of the main bars, and suppressing the lateral deformation of the main bars caused by the vertical load, and preventing brittle failure in which the reinforced concrete vertical member is instantaneously destroyed by allowing the main bar to behave plastically, especially, for stirrups at the main bars of columns, they are bent and anchored at 135 degrees while being anchored at least 6 times the diameter of the stirrup reinforcing bars or 75 mm or more to prepare for earthquakes.

FIG. 1 is a plan view showing the arrangement of the inner band reinforcing bar connecting the facing main bars in case of the prior art's reinforced concrete columns, beams, and shear walls.

In FIG. 1, the reinforced concrete column 1, which is one embodiment of the reinforced concrete vertical member, has the main bars 2 installed in a rectangular shape at predetermined intervals in the horizontal and vertical directions, and has the outer band reinforcing bar 3 installed in the transverse direction at the outer circumference of the main bars 2 along the axial direction of the main bars 2, and the inner band reinforcing bars 4 for binding the opposite main bars 2 are installed inside the outer band reinforcing bars 3 at predetermined intervals.

In the above conventional reinforced concrete columns, beams, and shear walls, the outer band reinforcing bar (stirrup) and the inner band reinforcing bar (connection reinforcing bar) bind the main bars, so that the buckling of the column main bars is suppressed and it is possible to resist the earthquake (seismic design), and the concrete inside the column is constrained by the inner and outer band reinforcing bars, which has the effect of increasing the rigidity of the reinforced concrete column.

However, the band reinforcing bar of said conventional reinforced concrete column has both ends bent at 90 degrees or 135 degrees to constrain the main bars of the column, and the phenomenon that the bent portions bent at 90 degrees or 135 degrees at both ends of the band reinforcing bar are unwound after the maximum resisting force occurs, thus there is a problem that the bending moment of reinforced concrete columns, beams, and shear walls is lowered.

In addition, in order to prevent the buckling of the main bars, the band reinforcing bars should be bent at 135 degrees, but construction is being made without sufficiently bending the band reinforcing bars for quick construction.

DISCLOSURE

Object of Invention

An object of the present invention is to provide an untying prevention device for preventing loosening of the stirrups and the band reinforcing bars installed on the main bars.

Another object of the present invention is to provide an untying prevention device for preventing moving on the band reinforcing bars after being installed on the band reinforcing bar.

Technical Solution

In order to achieve the above objects, according to one aspect of the present invention, a band reinforcing bar loosening prevention device may comprise a body portion that is provided in a form of surrounding an outer side surface, and upper and lower surfaces of a band reinforcing bar and that is coupled to the band reinforcing bar; a pair of extension portions that are provided respectively at both ends of the body portion and that are formed in different directions; a separation prevention portion that is provided respectively on both sides of the body portion to prevent the band reinforcing bar from being separated, and a constraint portion that is provided at each corner of the body portion and prevents vertical and outward movements when combined with the band reinforcing bar.

The body portion may comprise a first body portion facing the outer side surface of the band reinforcing bar; and a pair of second body portions that extend inward of the band reinforcing bar from both ends of the first body portion and face upper and lower portions of the band reinforcing bar.

The extension portion may comprise a pair of first extension portions that are provided respectively at one end of the pair of second body portions and extend in different directions; a pair of second extension portions that are provided respectively at one end of the pair of first extension portions and extend in an outer direction of the band reinforcing bars.

The separation prevention portion may be provided on one surface of the second body portion and is provided with a separation prevention clip bent in directions facing each other.

The separation preventing portion may be provided in the second body portion and may be provided with an inlet hole for allowing concrete to flow in between the second body portion and the band reinforcing bar during concrete pouring.

The constraint portion may comprise a constraint groove provided at both ends of the second body portion, respectively; and a constraint strap that is provided in a form of surrounding the second body portion from an outside, and that is seated in the constraint groove and entangles the second body portion.

The constraint strap may be formed of a steel wire.

The constraint portion may be provided on the outside of the second body portion and may comprise a constraint member that is coupled to the constraint strap in a snare shape, and is seated in the constraint groove, and entangles the second body portion.

The constraint member may be formed as a sleeve.

Advantageous Effects

According to the band reinforcing bar loosening prevention device according to the present invention, it is possible to prevent the band reinforcing bar installed on the main bars from loosening.

In addition, it is possible to prevent from moving on the band reinforcing bar after being installed on the band reinforcing bar.

DETAILED DESCRIPTION OF THE INVENTION

Hereinafter, the band reinforcing bar loosening prevention device according to one embodiment of the present invention will be described in detail with reference to the accompanying drawings as follows.

Figure 1:
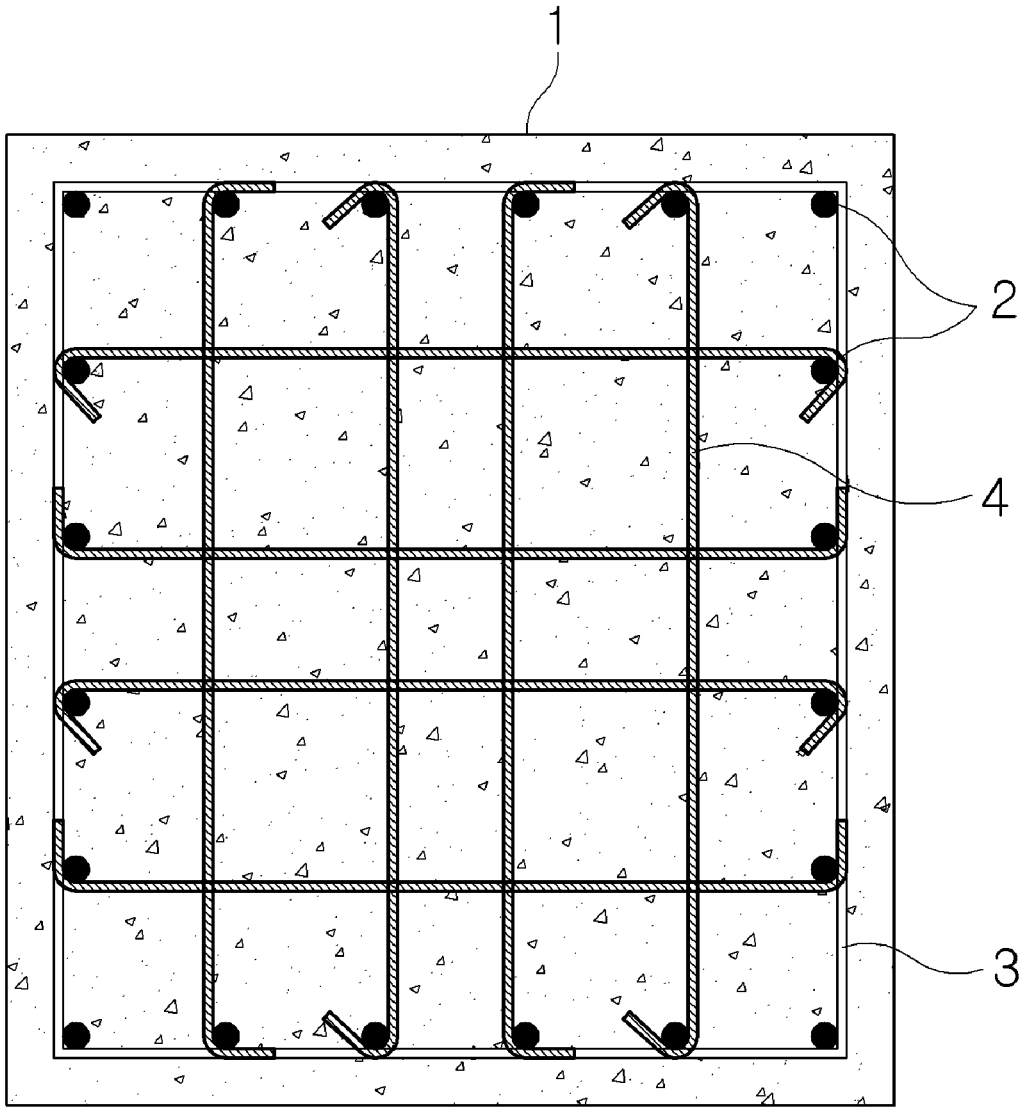
FIG. 1 is a view showing the prior art.
Figure 2:
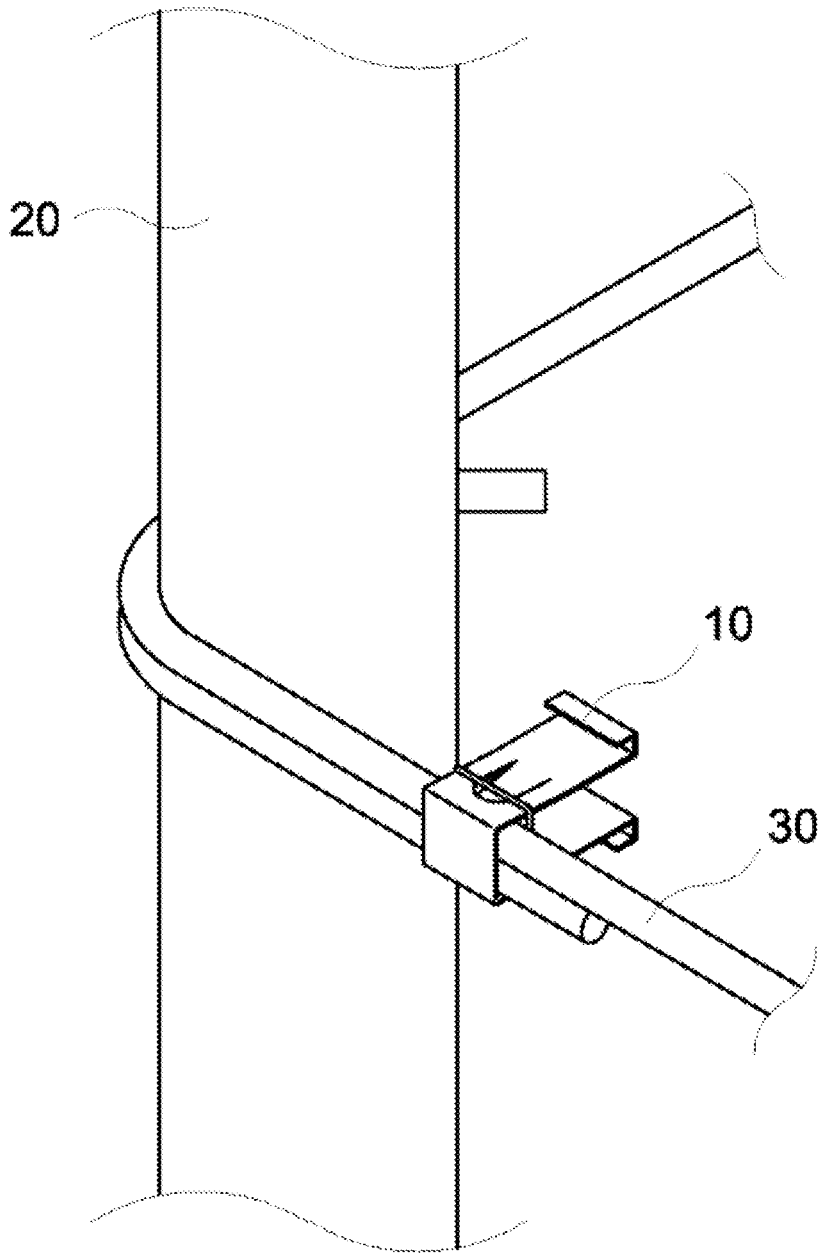
FIG. 2 is a perspective view showing a state in which the band reinforcing bar loosening prevention device according to an embodiment of the present invention is installed.
Figure 3:
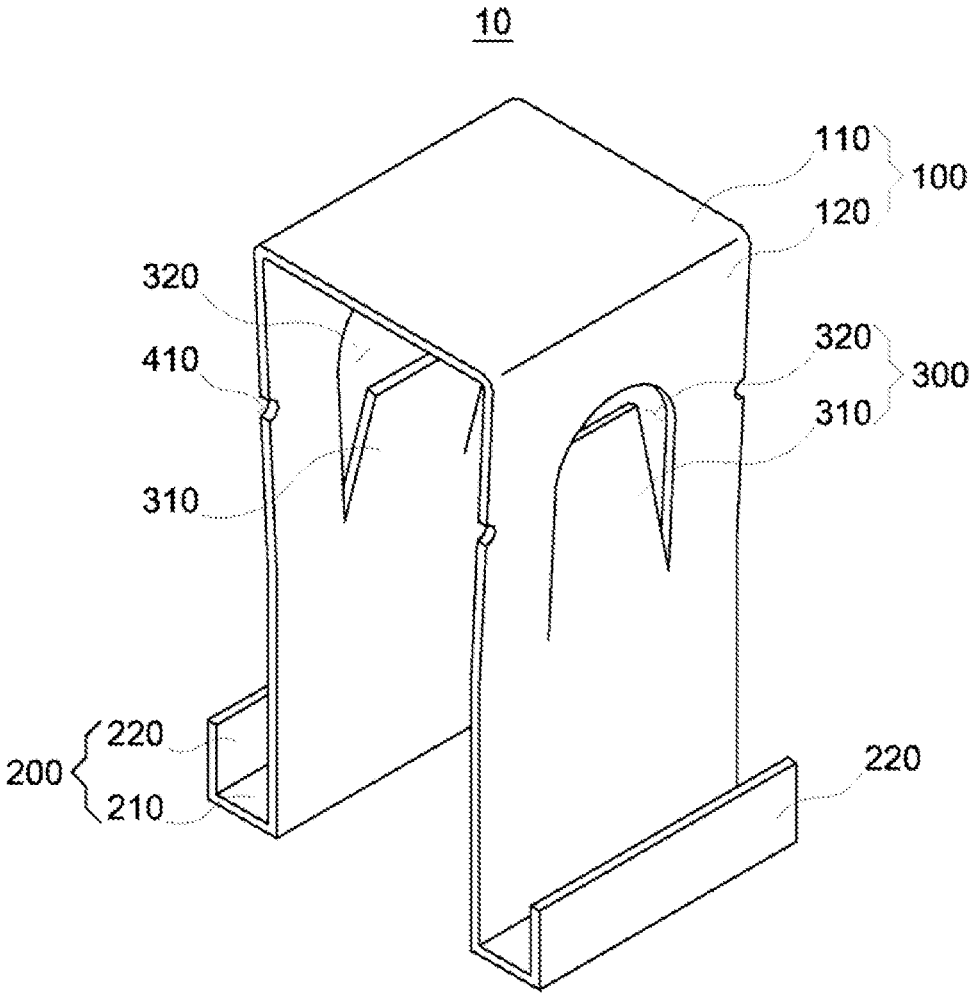
FIG. 3 is a perspective view of the band reinforcing bar loosening prevention device shown in FIG. 2.
Figure 4:
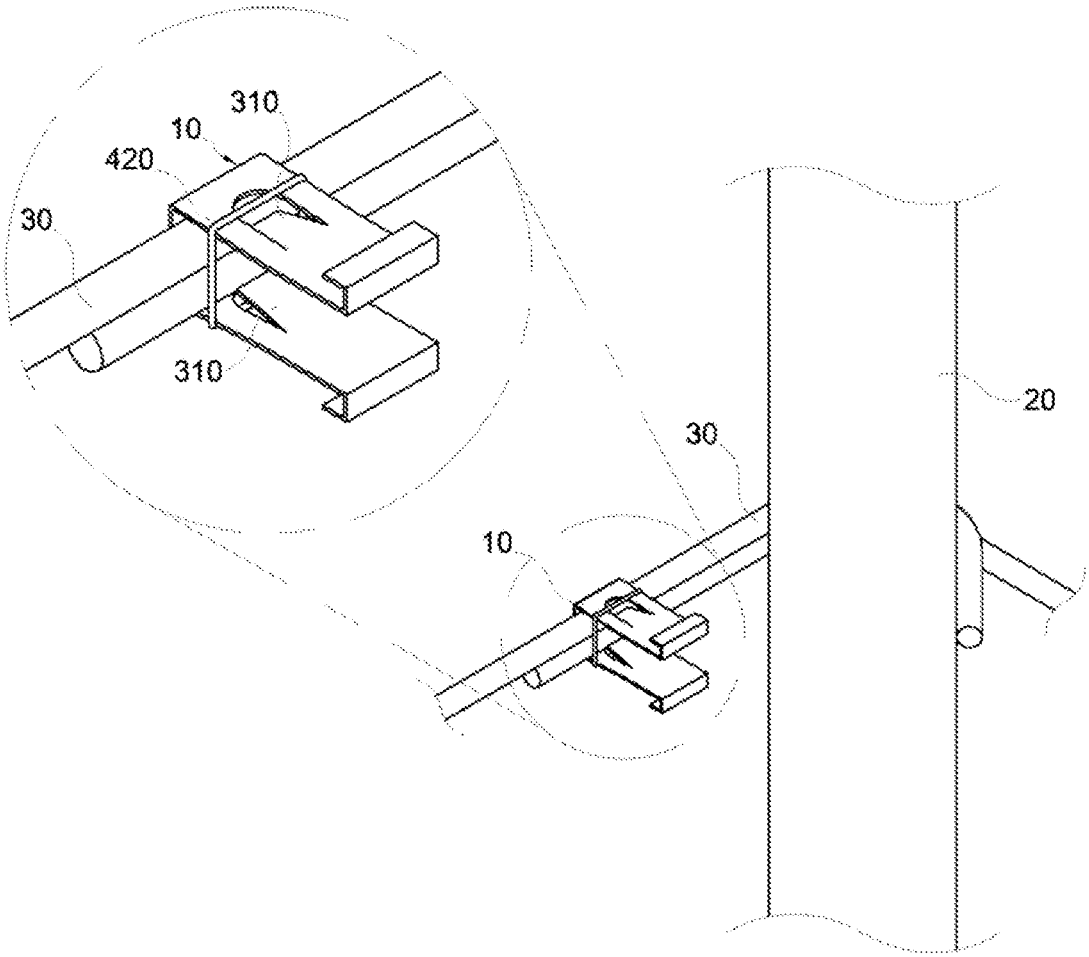
FIG. 4 is an enlarged perspective view of the band reinforcing bar loosening prevention device shown in FIG. 2, seen from the inside.

FIG. 2 is a perspective view showing a state in which the band reinforcing bar loosening prevention device according to an embodiment of the present invention is installed, and FIG. 3 is a perspective view of the band reinforcing bar loosening prevention device shown in FIG. 2, and FIG. 4 is an enlarged perspective view of the band reinforcing bar loosening prevention device shown in FIG. 2, seen from the inside.

As shown in FIGS. 2 and 3, the band reinforcing bar loosening prevention device 10 according to one embodiment of the present invention may be installed on the band reinforcing bar 30. The band reinforcing bar 30 may serve to delay the buckling of the main bar 20 by being installed on the main bar 20.

The band reinforcing bar loosening prevention device 10 may comprise a body portion 100, an extension portion 200, a separation prevention portion 300, and a constraint portion 400.

The body portion 100 may be manufactured in a 'ㄷ' shape and may comprise a first body portion 110 that is facing the outer surface of the band reinforcing bar 30, and a second body portion 120 that may extend at both ends of the first body portion 110 in an inward direction of the band reinforcing bar 30, respectively. The second body portion 120 may extend at a certain angle in the inward direction when extending from both ends of the first body portion 110 in order to further push the band reinforcing bar 30 into the first body portion 110. Here, the band reinforcing bar 30 may be positioned between the 'ㄷ'-shaped body portions 100 extending at a certain angle in the inward direction.

Meanwhile, the extension portion 200 is divided into a first extension portion 210 and a second extension portion 220. The first extension portion 210 is provided at one end of the pair of second body portions 120, respectively, may extend in different directions, that is, the first extension portion 210 provided on the second body portion 120 located in an upper part of the band reinforcing bar 30 may extend in an upward direction, and the first extension portion 210 provided in the second body portion 120 located in a lower part of the band reinforcing bar 30 may extend in a downward direction. And the second extension portion 220 may be provided at one end of the pair of first extension portions 210 to extend in the outer direction of the band reinforcing bar 30, respectively. Accordingly, the extension portion 200 flows in between the first extension portion 210 and the second extension portion 220 when concrete is poured after the band reinforcing bar loosening prevention device 10 is installed, so that it is possible to exhibit the effect of increasing the joining force of the band reinforcing bar loosening prevention device.

The separation prevention portion 300 is formed on one surface of the second body portion 120 and may be provided as a separation prevention clip 310 and an inlet hole 320. The separation prevention clip 310 is provided on one surface of the pair of second body portions 120, respectively, and may be bent in the inner direction of the band reinforcing bar 30. Here, the separation prevention clip 310 pushes the band reinforcing bar 30 positioned between the body portions 100 inwardly so that the band reinforcing bar 30 may be inserted between the separation prevention clips 310 in the body portion 100. In addition, the inlet hole 320 may be provided on one surface of the second body portion 120 or one surface of the pair of second body portions 120, and it is possible to exert the effect of increasing the binding force of the band reinforcing bar preventing loosening device 10 by allowing the concrete to flow in between the body portion 100 and the band reinforcing bar 30, when the concrete is poured after the band reinforcing bar loosening prevention device 10 is installed.

The constraint portion 400 may comprise a constraint groove 410 provided at both ends of the second body portion 120, respectively, and a constraint strap 420 that is provided in a form of surrounding the second body portion 120 from an outside, and that is seated in the constraint groove 410 and entangles the second body portion 120. The constraint strap 420 may be formed of a steel wire so as to wrap from the outside of the second body portion 120. Accordingly, the constraint strap 420 is fitted to be seated in accordance with the constraint groove 410 and is wound one or more times from the outside of the second body portion 120 to press the space between the body portion 100 to further restrain the band reinforcing bar 30.

Next, a description will be given of the band reinforcing bar loosening prevention device 10 according to another embodiment of the present invention. In the following description, only parts different from the above-described embodiment will be described in detail, and detailed descriptions of the same or extremely similar parts will be omitted.

Figure 5:
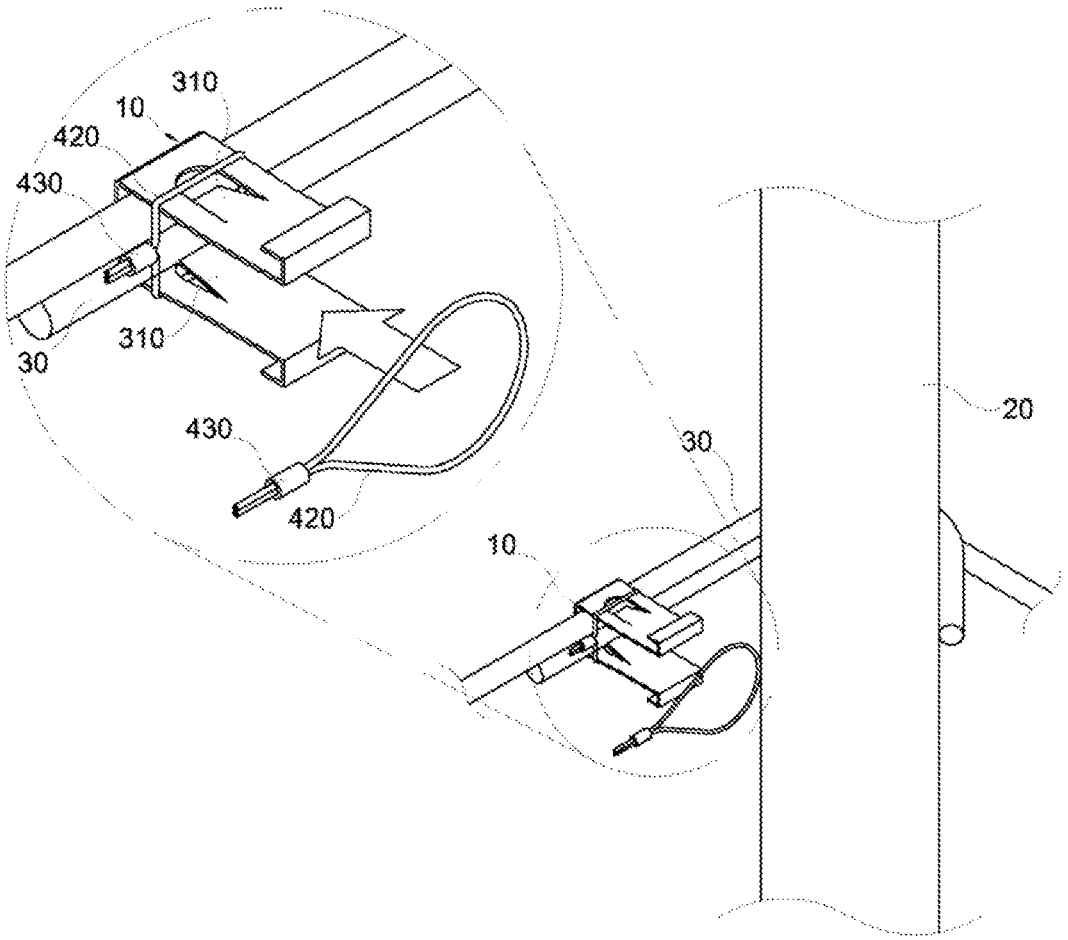
FIG. 5 is an enlarged perspective view of the band reinforcing bar loosening prevention device according to another embodiment of the present invention, seen from the inside.

FIG. 5 is an enlarged perspective view of a band reinforcing bar loosening prevention device according to another embodiment of the present invention as viewed from the inside.

As shown in FIG. 5, the band reinforcing bar loosening prevention device 10 according to another embodiment of the present invention may comprise a body portion 100, an extension portion 200, a separation prevention portion 300 and a constraint portion 400.

The constraint portion 400 is provided on the outside of the second body portion 120 and may comprise a constraint member 430 that is coupled to the constraint strap 420 in a snare shape, and is seated in the constraint groove 410, and entangles the second body portion 120. The constraint member 430 may be formed as a sleeve in order to simplify finishing work of the constraint strap 420 and increase convenience of installation. The constraint member 430 is provided in a cylindrical shape to couple the constraint strap 420 in a snare shape and wrap it from the outside of the second body portion 120 to be seated in the constraint groove 410. In addition, the constraint member 430 may be fixed by entangling the connected constraint strap 420 to the second body portion 120 and pressing the constraint member 430 with a tool.

On the other hand, the constraint member 430 may be located to be entangled on all sides except for the edge portion of the band reinforcing bar loosening prevention device 10 when it is finished to the second body portion 120.

As described above, as the band reinforcing bar loosening prevention device 10 is installed on the band reinforcing bar 30 through the separation prevention clip 310, rapid construction can be performed. In addition, it is possible to prevent the bending moment of the reinforced concrete column from being lowered, which is caused by the band reinforcing bar 30 to be loosened after the maximum bearing force, by the constraint portion 400 constraining the band reinforcing bar 30.

In the above, the band reinforcing bar loosening prevention device according to one embodiment of the present invention has been described, but the spirit of the present invention is not limited to the embodiments presented herein. Also, those skilled in the art, who understand the spirit of the invention, can readily suggest other embodiments by adding, changing, deleting, introducing or the like of components within the same spirit, and the other embodiments are also within the scope of the invention.

What is claimed is:

1. A band reinforcing bar loosening prevention device provided in a band reinforcing bar installed on a main bar to delay a buckling of the main bar to prevent the band reinforcing bar from loosening, wherein the band reinforcing bar loosening prevention device comprises, a body portion that is provided in a form of surrounding an outer side surface, and upper and lower surfaces of the band reinforcing bar and that is coupled to the band reinforcing bar;

a pair of extension portions that are provided respectively at both ends of the body portion and that are formed in different directions;

a separation prevention portion that is provided respectively on both sides of the body portion to prevent the band reinforcing bar from being separated, and a constraint portion that is provided at each corner of the body portion and prevents vertical and outward movements when combined with the band reinforcing bar.

2. The band reinforcing bar loosening prevention device according to claim 1, wherein the body portion comprises a first body portion facing the outer side surface of the band reinforcing bar; and a pair of second body portions that extend inward of the band reinforcing bar from both ends of the first body portion and face upper and lower portions of the band reinforcing bar.

3. The band reinforcing bar loosening prevention device according to claim 2, wherein the extension portion comprises a pair of first extension portions that are provided respectively at one end of the pair of second body portions and extend in different directions; and a pair of second extension portions that are provided respectively at one end of the pair of first extension portions and extend in an outer direction of the band reinforcing bars.

4. The band reinforcing bar loosening prevention device according to claim 3, wherein the separation prevention portion is provided on one surface of the second body portion and is provided with a separation prevention clip bent in directions facing each other.

5. The band reinforcing bar loosening prevention device according to claim 4, wherein the separation preventing portion is provided in the second body portion and is provided with an inlet hole for allowing concrete to flow in between the second body portion and the band reinforcing bar during concrete pouring.

6. The band reinforcing bar loosening prevention device according to claim 5, wherein the constraint portion comprises a constraint groove provided at both ends of the second body portion, respectively; and a constraint strap that is provided in a form of surrounding the second body portion from an outside, and that is seated in the constraint groove and entangles the second body portion.

7. The band reinforcing bar loosening prevention device according to claim 6, wherein the constraint strap is formed of a steel wire.

8. The band reinforcing bar loosening prevention device according to claim 7, wherein the constraint portion is provided on the outside of the second body portion and comprises a constraint member that is coupled to the constraint strap in a snare shape, and is seated in the constraint groove, and entangles the second body portion.

9. The band reinforcing bar loosening prevention device according to claim 8, wherein the constraint member is formed as a sleeve.

* * * * *